US012605608B1

(12) United States Patent
Papadopoulos

(10) Patent No.: US 12,605,608 B1
(45) Date of Patent: Apr. 21, 2026

(54) BICYCLE TRAINER HAVING ENHANCED FREEDOM OF MOTION

(71) Applicant: Larry C. Papadopoulos, North Plains, OR (US)

(72) Inventor: Larry C. Papadopoulos, North Plains, OR (US)

( * ) Notice: Subject to any disclaimer, the term of this patent is extended or adjusted under 35 U.S.C. 154(b) by 117 days.

(21) Appl. No.: 18/112,374

(22) Filed: Feb. 21, 2023

Related U.S. Application Data

(60) Provisional application No. 63/312,135, filed on Feb. 21, 2022.

(51) Int. Cl.
*A63B 69/16* (2006.01)

(52) U.S. Cl.
CPC ..... *A63B 69/16* (2013.01); *A63B 2069/162* (2013.01)

(58) Field of Classification Search
CPC ..... A63B 69/16; A63B 2069/162; A63B 2069/161–168; A63B 22/06; A63B 22/0605; A63B 2022/0611–0658
See application file for complete search history.

(56) References Cited

U.S. PATENT DOCUMENTS 6,126,577 A * 10/2000 Chang ..... A63B 26/003 D21/663
7,481,746 B2 * 1/2009 Ibarguren ..... A63B 22/0605 482/57
10,617,908 B2 * 4/2020 Lin ..... A63B 21/225
11,033,775 B2 * 6/2021 Chen ..... A63B 22/16
11,260,280 B2 * 3/2022 Papadopoulos ..... A63B 69/16
2005/0209064 A1 * 9/2005 Peterson ..... A63B 22/16 482/61
2007/0010377 A1 * 1/2007 Wu ..... A63B 69/16 482/61
2015/0065309 A1 * 3/2015 Bauer ..... A63B 24/0087 482/61
2015/0111704 A1 * 4/2015 Lin ..... A63B 22/0605 482/57
2017/0136293 A1 * 5/2017 Caccia ..... A63B 21/225
2018/0369675 A1 * 12/2018 Papadopoulos ..... A63B 69/16
2019/0134480 A1 * 5/2019 Liao ..... H02J 7/1407
2020/0122011 A1 * 4/2020 Papadopoulos ..... A63B 69/16
2021/0228939 A1 * 7/2021 McAllister ..... A63B 22/0605
2021/0252335 A1 * 8/2021 Brewer ..... A63B 22/0605

FOREIGN PATENT DOCUMENTS

EP 270256 A * 6/1988 ..... A63B 1/00065
EP 1364681 A1 * 11/2003 ..... A63B 21/0051
WO WO-2007083341 A1 * 7/2007 ..... A63B 69/16

* cited by examiner

*Primary Examiner* — Nyca T Nguyen

(57) ABSTRACT

A support for a front bicycle fork having a base and a support post, flexibly, but constrainedly, supported by the base. Also, a fork support is mounted on the support post. Finally, the support post is susceptible to sufficient movement to permit a rider on a bicycle with a front fork mounted on the fork support to move or rotate the front fork.

2 Claims, 3 Drawing Sheets

BICYCLE TRAINER HAVING ENHANCED FREEDOM OF MOTION

RELATED APPLICATION

This application claims benefit of provisional application U.S. Ser. No. 63/312,135 filed Feb. 21, 2022, which is incorporated by reference as if fully set forth herein.

BACKGROUND OF THE INVENTION

In the effort to provide a device for receiving a bicycle, or a portion of a bicycle, and supporting it in such a manner that a rider may pedal, and encounter resistance, and also move the handlebar, while providing a realistic mimicry of the feel of riding on a road, great advances have been made. There is a sense, however, that the rigidity of the linkages of existing devices detracts from a fully realistic feeling in steering. The present state of the art leaves room for improvement in permitting a user to move the handlebars and cause the bicycle frame to tilt in a manner that more accurately mimics the tilt action that a rider would experience while riding a bicycle on a road.

SUMMARY OF INVENTION

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

In one aspect, the present invention may take the form of a support for a front bicycle fork having a base and a support post, flexibly, but constrainedly, supported by the base. Also, a fork support is mounted on the support post. Finally, the support post is susceptible to sufficient movement to permit a rider on a bicycle with a front fork mounted on the fork support to move or rotate the front fork.

BRIEF DESCRIPTION OF DRAWINGS

Various embodiments of the invention are disclosed in the following detailed description and accompanying drawings.

DETAILED DESCRIPTION AND EMBODIMENTS

Figure 1:
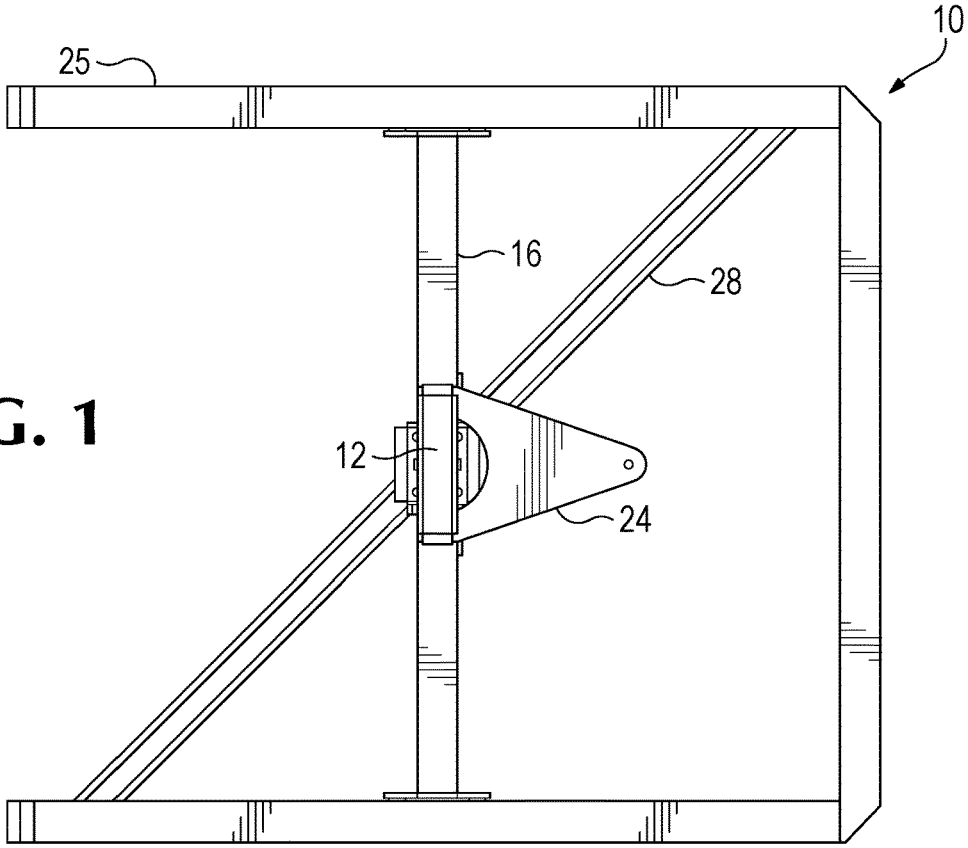
FIG. 1 is a plan view of a front bicycle fork supporting assembly, according to the present invention.
Figure 2:
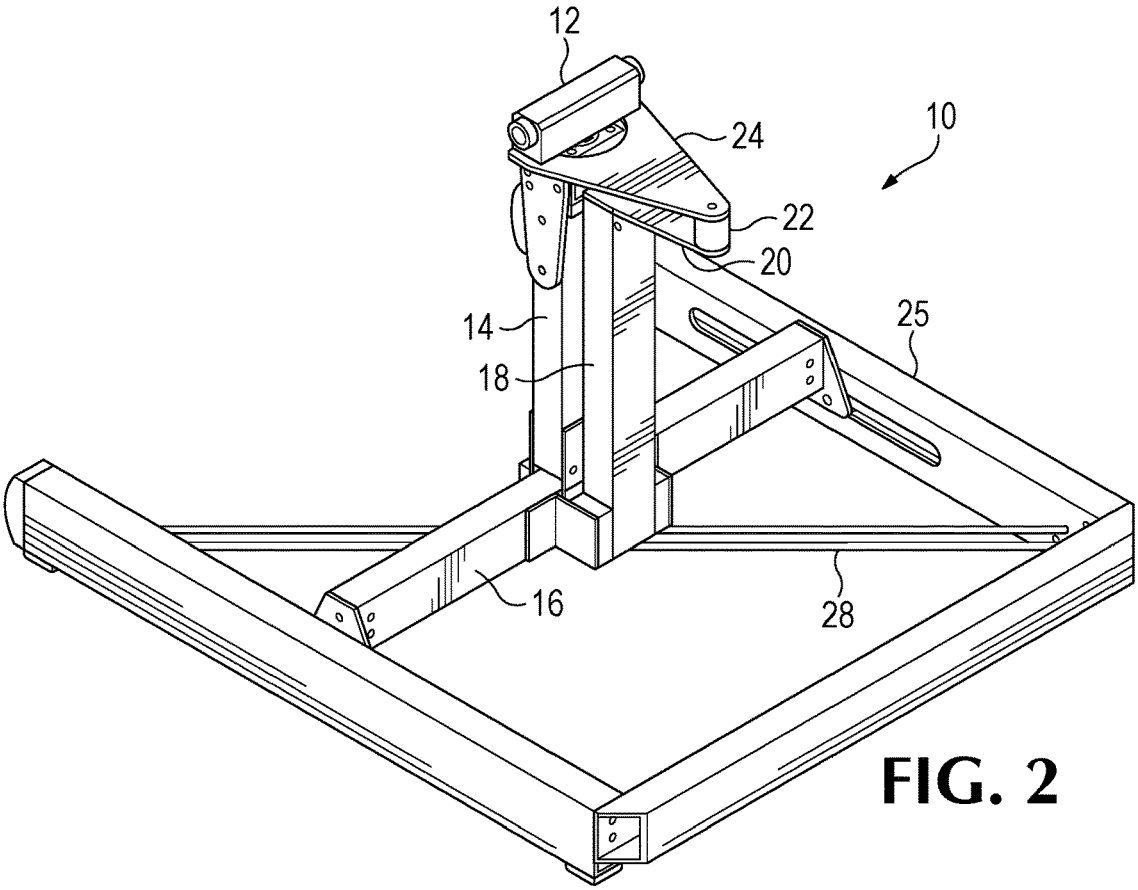
FIG. 2 is an isometric view of the assembly of FIG. 1.
Figure 3:
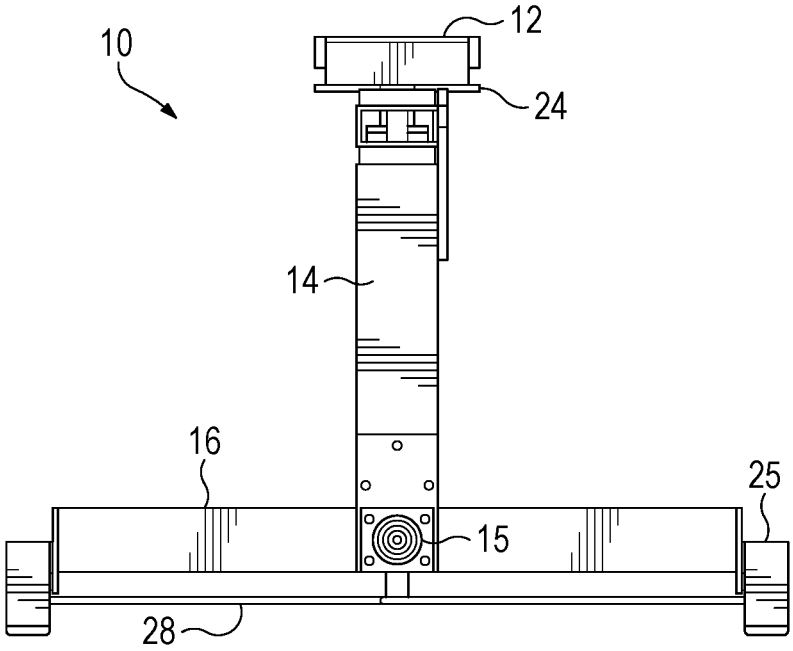
FIG. 3 is a front view of the assembly of FIG. 1.
Figure 4:
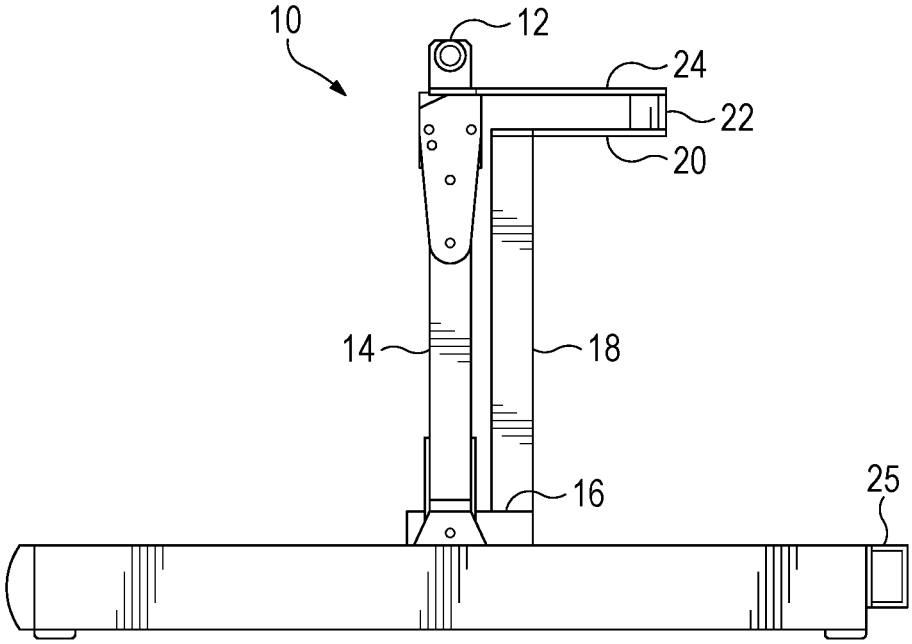
FIG. 4 is a side view of the assembly of FIG. 1.
Figure 5:
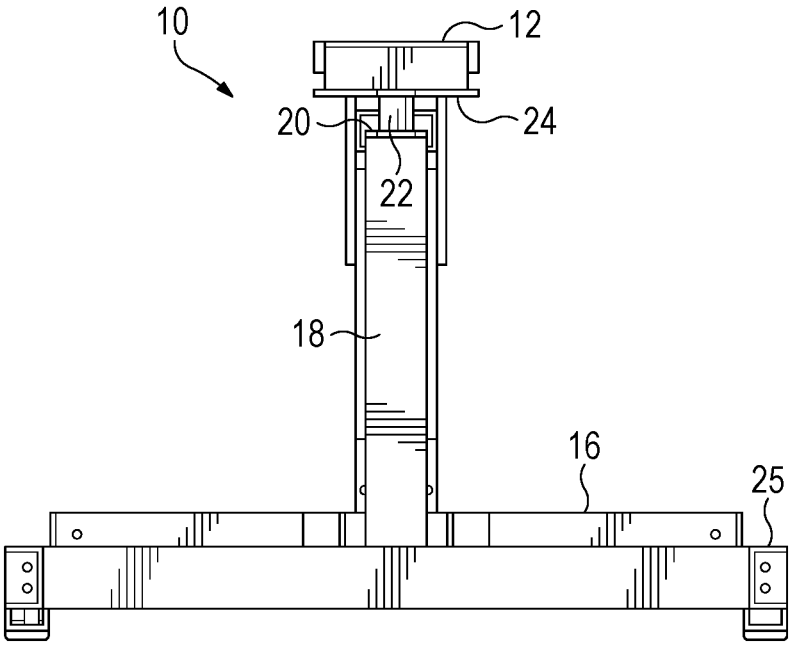
FIG. 5 is a rear view of the assembly of FIG. 1.

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

To assist the description of the scope and its components the coordinate terms ["upper", "lower," "front" and "rear"] are used to describe the disclosed embodiments. The terms are used consistently with the description of the exemplary applications and are in reference to the position of the bicycle trainer portion, relative to the orientation of a rider.

FIGS. 1-5 show a bicycle trainer portion 10, that is designed to be used to support the front wheel fork of a bicycle, in conjunction with an assembly for supporting the rear of a bicycle, as illustrated in U.S. Pat. No. 10,933,291. A front fork receiver 12 is adapted to receive the front bicycle fork (not shown) and to permit rotation thereof. Receiver 12 is rotatably supported by tilting fork post 14, which is itself vertically-rotatably supported at hinge 15 (defining a fork tilt axis), by a sliding cross-beam 16.

A post constraining mechanism includes a rigid reaction column 18, which is rigidly supported by cross-beam 16, and which is flexibly coupled to the fork receiver 12, by a rigid column tongue 20, a flex-coupling 22 (also referred to as a resiliently deformable element) and a fork receiver tongue 24. Both tongues 20 and 24 are rigid, whereas flex-coupling 22 is a cylinder of rubber or similar resiliently deformable material. Accordingly, although support 12 can tilt from side-to-side as post 14 swings from side-to-side, that movement is constrained within a range, and the resistance becomes stronger as flex-coupling is flexed and resists further deformation with greater force. As noted in FIG. 3, the axis of rotation of the receiver 12 (and thereby the bicycle front fork) is defined as the center axis of flex-coupling 22. Further the resilience of flex-coupling 22 urges receiver 12 back into a horizontal position. Cross-beam 16 is slidingly mounted in a base 25, by way of a slot 26 (FIG. 2), with the movement of cross-beam 16 being resisted by a rubber band 28.

Figure 6:
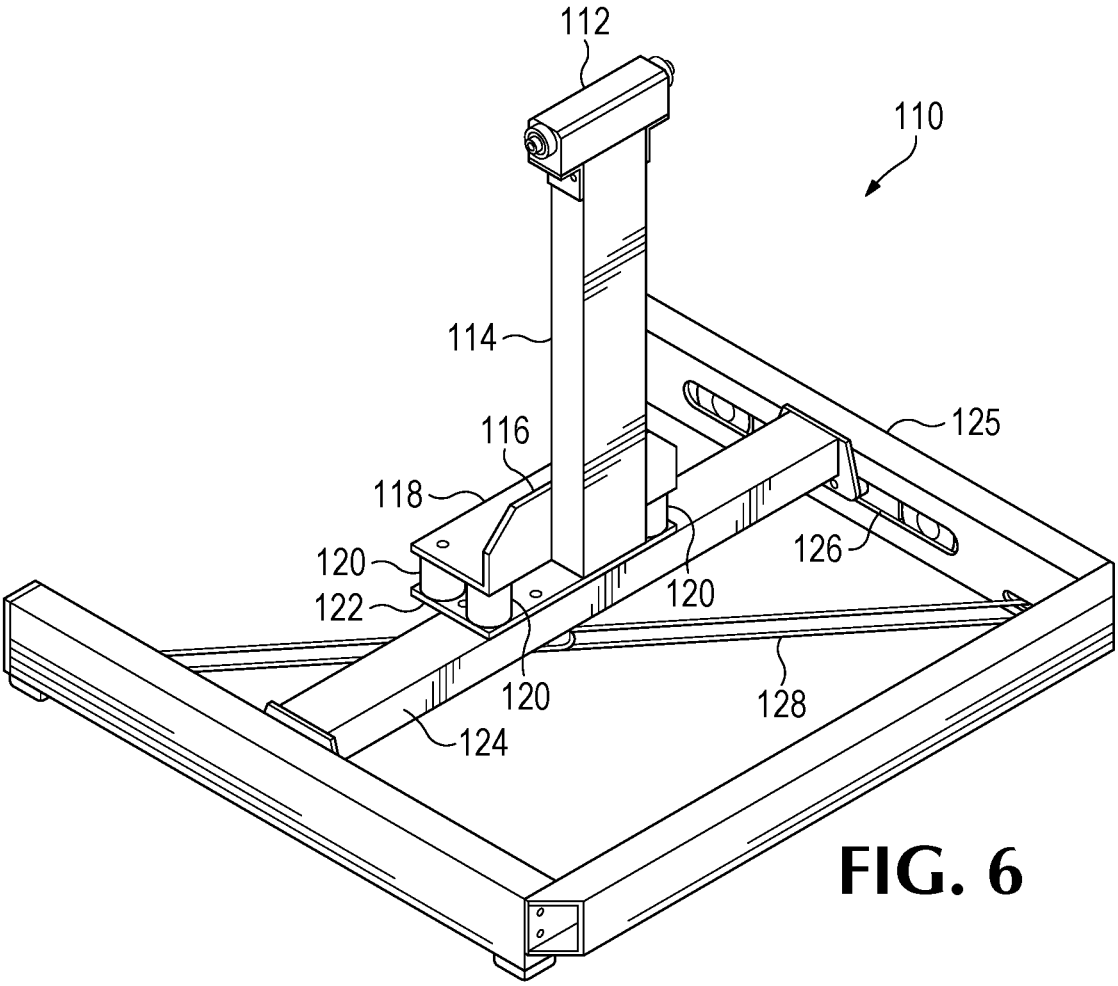
FIG. 6 is an isometric view of an alternative embodiment of a front bicycle fork supporting assembly.

An alternative embodiment 110 is shown in FIG. 6, wherein a front fork receiver 112 is supported by an upright strut 114, which is in turn rigidly mounted to a flange 116 of a mounting plate 118. A set of four flex members 120 (also referred to as resiliently deformable elements) support mounting plate 118 above bottom plate 122, which is rigidly attached to cross-beam 124 (parallel to cross-beam 16 of embodiment 10). Similar to embodiment 10, cross-beam 124 is slidingly mounted in a base 125, by way of a pair of slots 126 (FIG. 2), with the movement of cross-beam 124 being resisted by a rubber band 128. In a preferred embodiment, flex members 120 are vibration-dampening sandwich mounts, available from McMaster-Carr (which maintains a website at www.mcmaster.com) under part number 93945K36. These parts are 1 inch high and 1 inch in diameter and are made of black neoprene rubber. The shear capacity per mount is 8 lbs, and the deflection at shear capacity is 0.1 inch. The mount type is threaded stud and threaded insert.

Flex members 120 provide sufficient resisted movement of fork receiver 112, by way of strut 114, to provide a natural feel to a rider on a bicycle that has its front fork mounted on receiver 112.

The disclosed embodiments are illustrative, not restrictive. While specific configurations of the bicycle trainer portion have been described, it is understood that the present invention can be applied to a wide variety of training devices. There are many alternative ways of implementing the invention.

What is claimed is:

1. A support for a front bicycle fork, comprising:

(a) a base;

(b) a support post, flexibly, but constrainedly, supported by said base, said support post including a forward-projecting first tongue;

(c) a fork support mounted on said support post and connected to said first tongue; and (d) an additional post connected to said base and that includes a forward-projecting second tongue rigidly affixed to a top of said additional post, said second tongue being coupled to a forward portion of said first tongue by a resiliently deformable element, (e) wherein said support post is (i) susceptible to sufficient movement to permit a rider on a bicycle with a front fork mounted on said fork support to move or rotate said front fork, and (ii) constrained by said additional post.

2. The support for a front bicycle fork of claim 1, wherein said resiliently deformable element is a rubber cylinder.

* * * * *